United States Patent [19]

Roberts

[11] 4,233,083

[45] Nov. 11, 1980

[54] PRESORTED FLATWARE WASHING METHOD AND APPARATUS

[75] Inventor: Donald E. Roberts, Downers Grove, Ill.

[73] Assignee: Hillside Engineering, Inc., Hillside, Ill.

[21] Appl. No.: 967,207

[22] Filed: Dec. 7, 1978

[51] Int. Cl.[3] ..... B08B 7/04; A47L 15/24

[52] U.S. Cl. ..... 134/25.2; 134/63; 134/72; 134/128; 134/134; 134/156; 209/926

[58] Field of Search ..... 134/25 A, 62, 63, 70, 134/72, 126, 128, 131, 133, 134, 156; 209/926

[56] References Cited

U.S. PATENT DOCUMENTS

| | | | |
|---|---|---|---|
| 3,247,858 | 4/1966 | Kraeft | 134/63 X |
| 3,486,939 | 12/1969 | Pinckard | 134/63 X |
| 3,520,726 | 7/1970 | Gay | 134/63 |
| 3,938,533 | 2/1976 | Richard | 134/62 X |
| 4,063,634 | 12/1977 | Perry | 134/126 X |

*Primary Examiner*—Marc L. Caroff
*Attorney, Agent, or Firm*—Edmond T. Patnaude

[57] ABSTRACT

Apparatus and methods are disclosed for containing, washing, rinsing and drying presorted flatware by category, after which the flatware is automatically discharged from the apparatus by category into separate receiving receptacles. Alternate types of conveyors, containers and methods of discharging flatware from containers are included, and certain embodiments provide simultaneous washing of other tableware within the same apparatus.

9 Claims, 12 Drawing Figures

FIG. 8
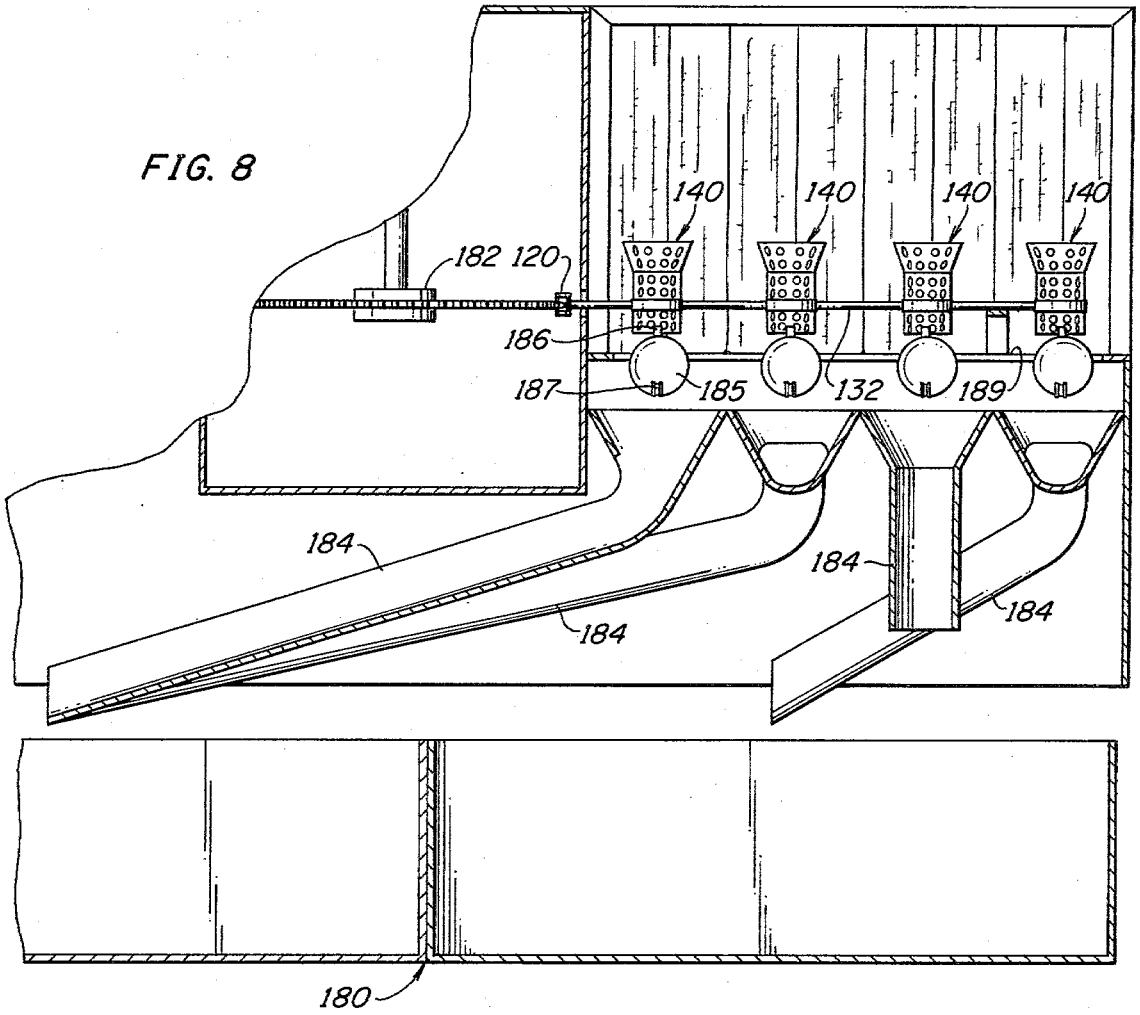
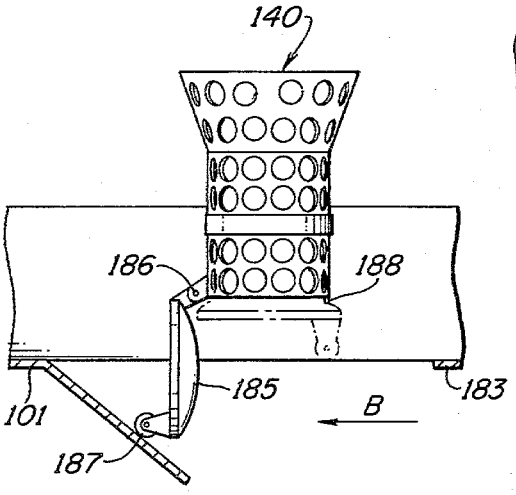
FIG. 9
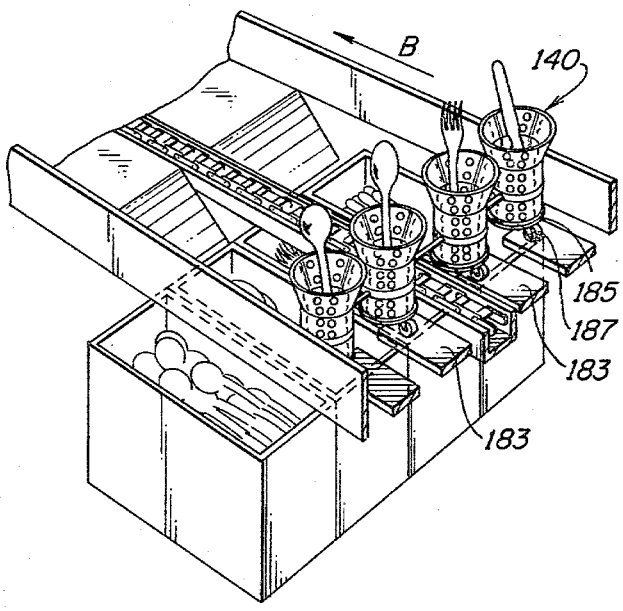
FIG. 10

PRESORTED FLATWARE WASHING METHOD AND APPARATUS

The present invention relates in general to methods and apparatus for automatically washing eating utensils and the like, and it relates in particular to new and improved methods and apparatus for use in sorting and washing large quantities of reusable flatware in, for example, mass feeding establishments such as hospitals, restaurants and the like.

BACKGROUND OF THE INVENTION

Washing of reusable flatware in mass feeding establishments generally entails the placing of the flatware in a presoak liquid such as water to soften any food particles which may be encrusted thereon. Subsequently the flatware is manually removed from the presoaking vessel and placed in bunches in perforated containers. The containers are then loaded into a dish washing machine for movement through washing and rinsing stations. It is not uncommon for similar items of flatware to nest together or the pieces of flatware otherwise to shield one another from the washing and rinsing sprays thereby to interfere with the proper washing and sanitizing of the flatware. After processing, the flatware containers are removed from the dishwashing machine and the common practice is to manually sort the washed and sanitized flatware into categories of like items.

Aside from sanitary considerations, the repeated handling of the flatware is costly. In a typical installation the flatware is normally handled five or six times in the soaking, washing and sorting processes. Consequently, it would be desirable to reduce the manual handling of the flatware and to eliminate all manual sorting thereof after the washing operation. In this manner the sanitation will be greatly improved because of the reduced handling, and a considerable savings in labor and overall cost will be achieved.

In mass feeding establishments flatware is ordinarilly washed in automatic commercial dishwashers designed to wash dishes and drinking glasses as well as large trays and the like. Commercial dishwashers, designed to wash breakable dishes and drinking glasses as well as large trays and the like, must of necessity employ moderate spray pressures to minimize breakage and have upper spray orifices highly spaced apart from smaller items, such as flatware, resulting in reduced spray pressure at the point of spray contact with such smaller items. Accordingly, because of the many crevices usually found in flatware shapes and the tendency of food particles to tenaciously adhere to flatware, the cleanliness of the washed flatware frequently leaves much to be desired. It would be desirable therefore, to provide an automatic washing machine particularly designed for cleaning and sanitizing flatware by insuring that high velocity sprays of the washing and rinsing liquids directly impinge on all the areas of the flatware where food items most commonly adhere.

SUMMARY OF THE INVENTION

Briefly, there is provided in accordance with one aspect of the present invention a new and improved method of washing flatware wherein the flatware is sorted by items of similar category, i.e. forks, spoons, knives etc., as it is loaded into separate flatware containers attached to a continuous conveyor. The sorted flatware is carried by the conveyor through a plurality of cleaning stations and then automatically deposited in the sorted condition into suitable separate receptacles.

In accordance with a feature of the invention the machine is designed to discourage the placing of more than one or more pieces of flatware in each container. To this end the flatware containers are fixedly attached to the conveyor so as to move rapidly through the loading station and the containers are relatively small in diameter. Because of the small number of pieces in each container, the pieces of flatware do not overlie one another during the cleaning process.

In accordance with another aspect of the invention the containers which carry the flatware through the washing machine incorporate means which encourage rotation or twisting of the flatware pieces within the receptacles by laterally directed high velocity sprays of the washing and rinsing liquids which impinge on the pieces as they are carried through the machine. Moreover, in one embodiment of the invention the containers are mounted on springs so as to cause the pieces of flatware to move irregularly and abruptly under the varying forces exerted by the liquid sprays, which movement enhances the effectiveness of the sprays to dislodge food particles from the flatware.

In accordance with further aspects of the invention novel means are provided for automatically discharging the items of flatware from the containers into the receptacles. One disclosed embodiment of the invention is particularly suited for use with a flight type conveyor washing machine while another disclosed embodiment is the best suited for use with a carousel type conveyor washing machine.

GENERAL DESCRIPTION OF THE DRAWINGS

The present invention will be better understood by a reading of the following detailed description taken in connection with the accompanying drawings wherein:

FIG. 8 is a vertical section of the machine of FIGS. 6 and 7 taken along the line 8—8 of FIG. 7;

FIG. 9 is an enlarged view showing one of the flatware containers at the discharge station in the machine of FIG. 6;

FIG. 10 is a view showing a discharge station in a carousel type washing machine wherein the processed flatware is dropped directly into the receiving receptacles;

DETAILED DESCRIPTION OF THE INVENTION

Figure 1:
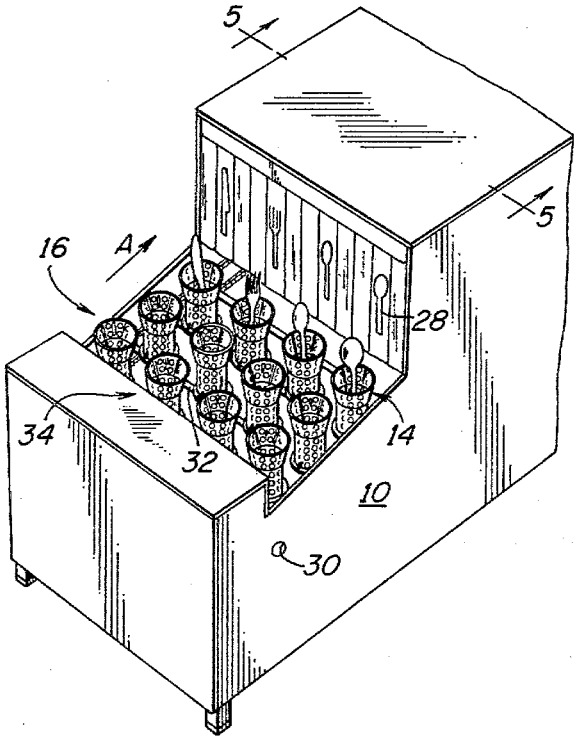
FIG. 1 is a perspective view showing the loading station at the front of a flatware washing machine embodying the present invention.
Figure 2:
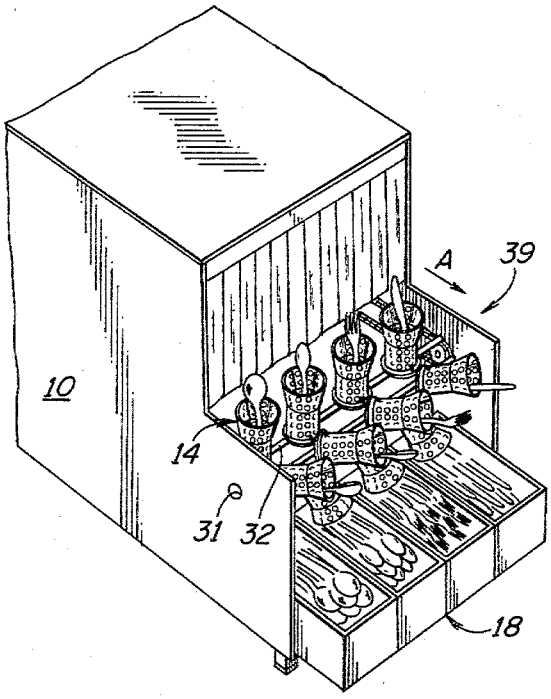
FIG. 2 is a perspective view showing the unloading station at the rear of the washing machine shown in FIG. 1.

Turning first to FIGS. 1 and 2, there is shown in perspective the loading and discharge ends of a form of the subject novel flatware processing apparatus which here includes a suitable elongated cabinet 10 housing a plurality of cleaning stations including for example, prewash, wash, rinse and drying stations, a continuous conveyor 12 (FIG. 3) moving in the direction of arrow A, a number of flatware washing containers 14 attached to the conveyor 12 in a repetitive series of like container groups 16, a plurality of flatware receiving receptacles 18 and an assortment of flatware items including knives, forks teaspoons and boullion spoons. In general, a machine operator (not shown), upon being supplied with a mixture of soiled flatware, places said items of flatware into containers 14 for conveyorized processing within the apparatus and automatic discharge into the respective receptacles 18 for transport to points of usage or storage.

Figure 3:
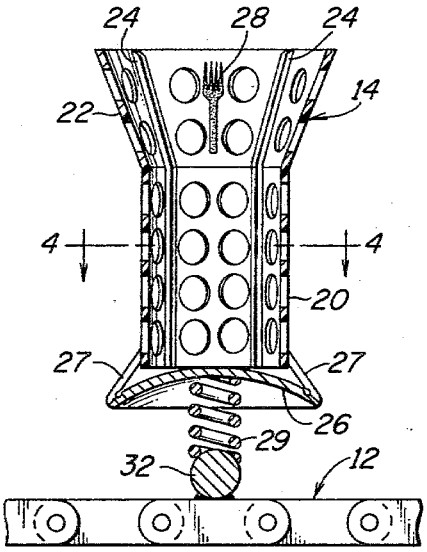
FIG. 3 is an elevational view, in cross-section, of one of the flatware containers used in the machine of FIG. 1.

As best shown in FIG. 3, the containers 14 each includes a body portion 20 in the general shape of a rounded right cylinder formed of perforated or comparably permeable material, and a flared top 22 for ease in loading. Internal flatware control ribs, or other suitable projections 24 are provided on the inner wall of both the body and top portions of the containers. The body 20 preferably has an internal diameter of between one and two inches and the top 22 flares outwardly to a maximum diameter of between two and three inches. A domed container bottom 26 is attached to the cylinder 20 by a plurality of arms 27 and extends downwardly and outwardly past the sides of the cylinder 20 to help retain contained flatware. The convex upper surface of the bottom 26 is sloped and spaced apart from the bottom edge of the body 20 to permit food soil particulate to readily flush out of the container 14. Each such flatware washing container 14 also includes one or more visible images or indicia 28 of a specific item of flatware, for example, a fork image as shown in FIG. 3. Other containers 14 include a knife image, a teaspoon image etc. The image, or images, on each container 14 are of but one category of flatware and are located so as to be readily discernable to the operator who places soiled flatware of corresponding category only into the containers. Variations in color may also be used in conjunction with each item image 28, or as a sole means, to designate a single category of flatware to be loaded into a specific container 14. Such images may also be placed on the cabinetry or curtains at the inlet to the processing stations as shown in FIG. 1 and elsewhere to provide further guidance for the proper categorical loading of flatware in the containers. The container illustrated in FIG. 3 also includes a resilient member which provides the sole means of attachment of the container to the conveyor. As shown best in FIG. 3, a coil spring 29 is affixed to the bottom 26 as by welding and is attached to a cross rod 32 which is in turn affixed as by welding to the conveyor 12. It is within the spirit and scope of this invention, however, that the containers 14 may be of square or other shape. If desired, they can be joined together in a single common structure embodying two or more categorically identified containers so as to form a unitized container group, such composite structure then being affixed to the conveyor 12.

In accordance with a unique aspect of this invention it shall be noted that, in the form of the subject apparatus and methods as shown in FIG. 1, each like container group 16 is disposed transversely upon the conveyor 12 and rods 32 in an identical arrangement of containers 14. For example, each container group may consist of one container 14 designated to receive only knives, another container 14 designated to receive only forks, another container 14 designated to receive only teaspoons and another container 14 designated to receive only soup spoons. It shall be further noted that the said likeness of the successive container groups insures that each group includes the same number of containers in the same categorical assortment with the same relative categorical positions and the same spacing of containers 14 one to another.

The conveyor 12 may be of the type of endless horizontal conveyor known in the food service industry as a flight-type conveyor. This form of conveyor operates between parallel horizontal shafts 30 and 31 in such manner that the conveyor 12 and the attached containers 14 move horizontally, as indicated by arrow A, in one direction with the containers 14 in an upright posture. Upon reaching a lateral extremity of the conveyor 12 at the discharge end of the machine as shown in FIG. 2 the containers 14 invert around shaft 31 and, so inverted, move horizontally in the opposite direction until reaching the lateral extremity at the front end of the machine as shown in FIG. 1. The conveyor 12 and the containers 14 then rotate around shaft 30 and again assume an upright posture as shown. As can be envisioned from FIG. 1, the machine operator (not shown), is positioned at the machine loading station 34 and places soiled items of flatware, by category, into the appropriate categorically identified containers 14 as they assume an upright posture and present themselves at the loading station 34. Since the novel apparatus and methods of the invention provide that the containers automatically move past the loading station and other empty containers automatically present themselves within easy reach of the machine operator, the operator realizes no motivation to overload the containers in the manner that is normal practice with manually controlled flatware washing containers as utilized with known flatware washing apparatus and methods. Rather, the loading of a single flatware item into each container 14 is facilitated and overloading is discouraged by the subject apparatus and methods. Thereby the phenomena of nesting and shielding of a substantial multiplicity of tightly held flatware items within a single washing container is eliminated. In this manner full exposure of the flatware to washing and rinsing sprays is facilitated and effective washing and sanitizing are promoted.

After passing through the loading station 34, the containers 14 and the flatware items carried thereby pass through successive cleaning stations which include an optional pre-wash station which may be included in high volume forms of the apparatus where it is desired to first flush loose food soil particulate from flatware with a flow of liquid which carries such food soil directly out of the apparatus in the manner known in conventional dishware washing apparatus. The containers 14 and flatware items then pass into the pressure wash station where pumped pressure sprays of heated, detergent laden water remove tenacious food soil from all surfaces of all flatware items. The containers and flatware next pass into a rinse station where sprays of fresh water are directed upon all surfaces of the flatware. Thereafter, the containers and flatware are conveyed through a drying station and thence out of the apparatus cabinetry to a discharge station 39. It shall be noted that the various processing stations are divided one from another by flexible curtains known in conventional warewashing apparatus to inhibit mixing of fluid sprays, air streams and the like.

As can be seen from FIGS. 1 and 2 the likeness of the successive container groups generates common paths of travel for all containers 14 of like category. Accordingly, all containers 14 of like category invert and discharge flatware items of like category at the same point in the discharge station 39. As shown in FIG. 2, the number of receptacles 18 is equal to the number of categories of containers 14 per container group. Therefore, each receiving receptacle being disposed below one of the separate points of container inversion, receives but one category of flatware. Accordingly, the novel apparatus and methods of this invention provide that differing categories of flatware shall be simultaneously processed and shall be automatically discharged without inter-mixing of categories and without need for post-washing manual sorting.

Figure 5:
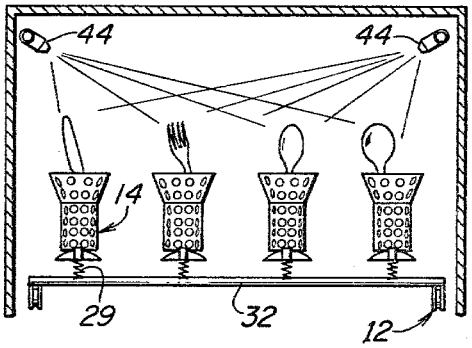
FIG. 5 is a cross-sectional view taken along the line 5—5 in FIG. 1.
Figure 4:
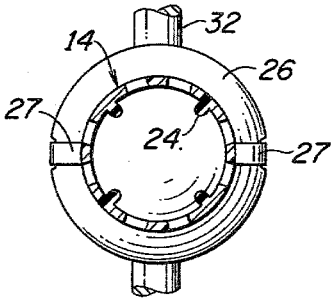
FIG. 4 is a cross-sectional view taken along the line 4—4 in FIG. 3.

As shown in FIG. 5 and in accordance with another aspect of the invention, liquid spray nozzles 44 are uniquely located to provide complete and thorough washing and rinsing of the flatware. The nozzle arrangement shown in FIG. 5 is used in the washing, rinsing and optional prewash sections of the machine 10. It will be noted that nozzles 44 are not located directly above and below the conveyor and contents as such nozzles are located in known ware-washing apparatus. Rather these nozzles 44 are located above and specifically to the side of the conveyor 12, the containers 14 and the flatware items. In this manner nozzle spray patterns strike the essentially vertical flatware from partially lateral directions, thereby affording more complete spray contact with all flatware surfaces, including critical and difficult to clean concave surfaces such as the bowls of spoons. Likewise, the nozzles 44 are located closely adjacent to the flatware items so as to provide maximum fluid pressures against the flatware and optimum washing and rinsing effects. The nozzles are, moreover, located on opposite sides of the conveyor 12 at linearly staggered intervals as shown best in FIG. 12 so that as the conveyed flatware items 19 are intermittently struck by sprays from alternating orientations, the flatware is jostled about in the containers 14. Such jostling further induces exposure of all surfaces of all items to the washing and rinsing effects of the sprays.

This enhanced exposure to the sprays is yet further facilitated by the container internal flatware control ribs 24 (FIG. 3). As spray pressures intermittently impel flatware items to move within the containers 14, the moving flatware items contact ribs 24 and sliding action against the inner surface of the container is converted to tumbling, twisting or rotating action. Flatware items which tumble or twist within the containers more frequently expose all of their surfaces to sprays. Such action is of particular benefit as a machine operator may occasionally load more than one flatware item of like category and shape into a single container 14. Such adjacent and alike flatware items normally tend to nest together or otherwise shield one another from sprays. Accordingly, as their movement within the container is converted by the ribs 24 to tumbling, twisting or rotation, they are frequently induced to alter their relative positions, one to another. In this manner the undesirable nesting or shielding is offset and their surfaces are more frequently exposed to the thorough washing and rinsing effects that are desired.

Further, inasmuch as the containers 14 each include a resilient attachment member 29, as shown in FIG. 3, the intermittent exposure to sprays from differing orientations imparts an intermittent tilting or bobbing action to the containers and increased jostling of the contained flatware items. Such dynamic container action also serves to further amplify the defined function of the ribs 24. Through this novel combination of unique spray nozzle location, unique flatware control ribs and unique flexible container mounting, the most desireable flatware washing and rinsing results are attained.

Although not visible in FIGS. 1 and 2, the machine 10 includes a drying station through which the flatware passes before reaching the discharge station 39. Suitable ducting supplies pressurized air to orifices which are located to provide complete and thorough exposure of the flatware to streams of drying air. These air orifices are positioned closely adjacent the passing flatware and address the flatware items from an oblique orientation so as to force water droplets off the critical food contact surfaces of the essentially vertical flatware in particular the difficult to dry concave surfaces. In addition, the air orifices are linearly staggered along the path of flatware travel so as to provide drying effects from intermittently variable directions. In this manner unsightly and unsanitary water spots and streaks resulting from ineffective flatware drying are reduced or entirely eliminated.

An alternate form of the invention is shown in FIGS. 6–9. Here, a machine cabinet 100 includes a conveyor table 101 underlying the exposed loading station 102. Cabinet 100 houses internal processing or cleaning stations structured like those previously described. In addition, cabinet 100 houses an endless conveyor 120 (FIG. 7) moving in the direction of arrow B and categorically designated containers 140 attached to the conveyor 120 by respective ones of a plurality of rods 132 in a repetitive series of like container groups 160. Also included are a number of flatware receiving receptacles 180 equal in number to the number of categories of containers per container group. Again, a machine operator places flatware into containers 140 by category for conveyorized processing within the apparatus and automatic discharge in the sorted condition into corresponding receiving receptacles 180. This form of the invention, like that previously described, provides that all containers 140 of like category follow a common path of travel and discharge flatware of but one category into but one receiving receptacle.

Figure 6:
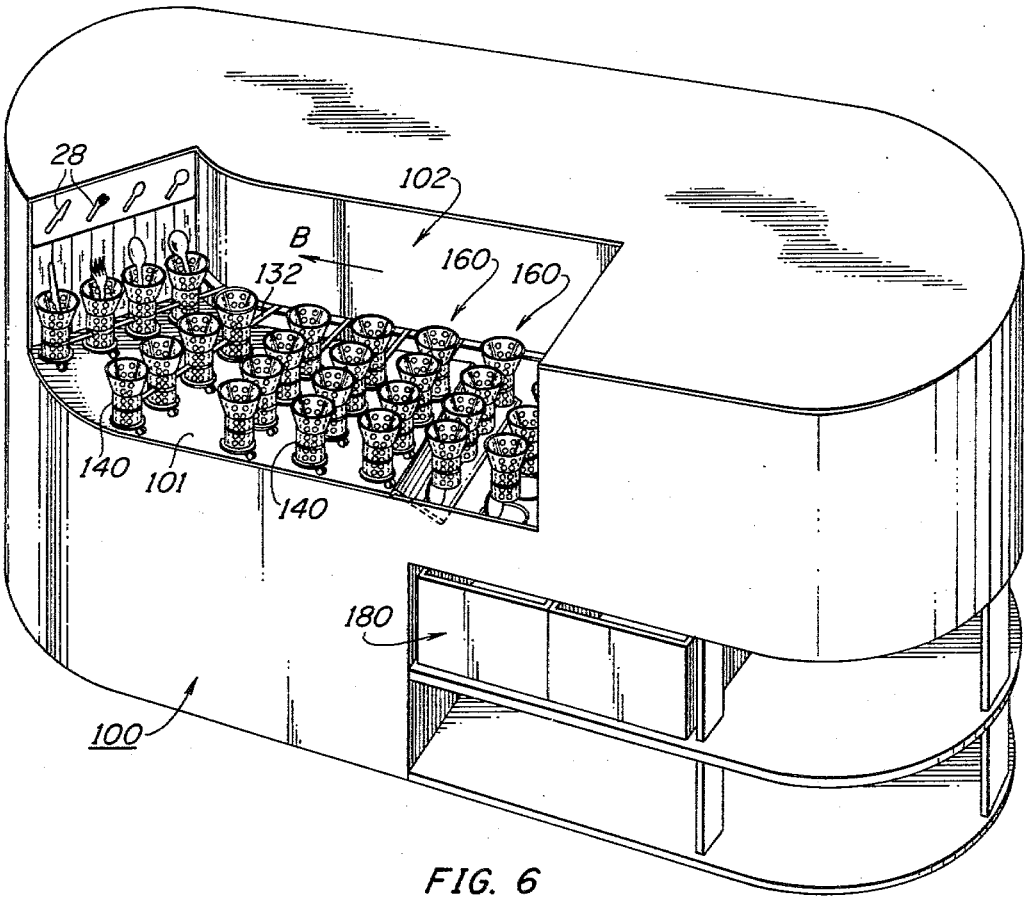
FIG. 6 is a front view of a carousel type flatware washing machine embodying other features of the present invention.

It may be noted, from FIG. 6, that flatware item images 28, as previously included as a feature of flatware containers (FIG. 3), are herein also included as a feature of apparatus cabinetry. As applied adjacent the loading station 102 above the external curtain portion of the cabinet 100, and other cabinets of the invention, images 28 correspond in categorical pattern to images included on associated flatware containers. In this manner, the machine operator is provided with further guidance in the proper categorical loading of flatware into the apparatus.

Figure 7:
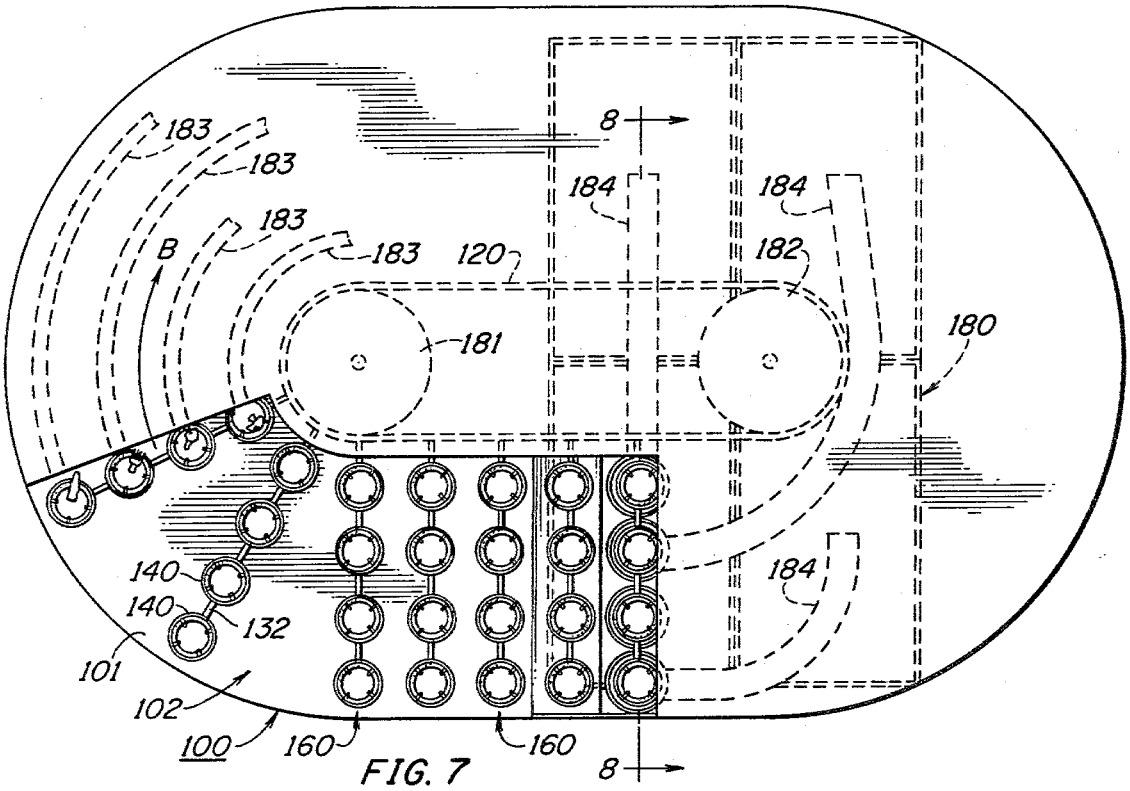
FIG. 7 is a top plan view of the washing machine shown in FIG. 6.

As shown, the endless conveyor 120 is of that type generally known in the food service industry as a carousel type conveyor. This conveyor rotates about two vertically shafted pulleys 181 and 182 and the conveyor travel is within but one horizontal plane, there being no vertical rotation or container inversion. FIG. 7 also shows cam tracks 183, which are equal in number to the number of containers 140 per container group 160. These cam tracks 183 are disposed parallel to one another along the paths of travel of the containers 140 throughout the processing stations. It shall be noted, however, that all cam tracks 183 terminate at the discharge station (FIG. 9). The cam tracks are supported within the cabinet by means of a plurality of transversely disposed support rods 189, one of which may be seen in FIG. 8. Also shown are optional flatware discharge chutes 184, also equal in number to the containers 140 per container group.

Since the containers 140 do not invert to discharge flatware, alternate novel means for such flatware discharge is provided. As shown in FIG. 9, the containers 140 each include hinged bottoms 185 of dome shaped configuration affixed, as by pin 186, to the containers 140. These hinged bottoms 185 are provided with cam track followers 187 located to ride upon conveyor table 101 through the loading station 102 and upon cam tracks 183 through the processing stations in the cabinet. In this manner, the hinged container bottoms 185 are held in the closed positions against the depending spacer lugs 188 during container 140 travel, except for travel within the discharge station. Thus, the hinged container bottoms 185 are automatically swung to open position, as shown in FIG. 9, as the containers 140 enter the discharge station above the mouths of the chutes 184. In such manner flatware is automatically discharged by falling from such hinged bottom containers into the chutes 184 and thus into the corresponding receptacles 180. As shown in FIG. 10, processed flatware may alternatively be discharged so as to fall directly into separate receiving receptacles. Where, however, the size of the receptacles or the cabinet does not allow placement of the receptacles directly below the discharge station, flatware discharge chutes 184, as shown in FIG. 8, may be provided to receive the flatware items and thereby direct them into separate receptacles 180. The latter option as shown in FIGS. 6, 7 and 8 is applicable when receiving receptacle capacity and space considerations so dictate.

Apparatus and methods as described herein have the capability to process very substantial volumes of flatware in short periods of time. For example, if the apparatus shown in FIGS. 6–8 provides a path of container travel (for the inner row of containers located toward the center of the machine) of 72 inches, and if the containers are moved at the rate of 15 seconds per foot, all the containers in all the groups will move through all the stations every 90 seconds. If the container groups are spaced apart on 3 inch centers, the conveyor operates and moves some 24 container groups. If each such container group consists of four containers, ninety-six containers pass through all stations each ninety seconds. Accordingly, if but one item of flatware is processed in each container, 3,840 flatware items are completely processed within a period of but one hour. Such performance shall be accomplished with the expense of but one handling of the flatware and with but one operator of minimal experience, skill and apptitude.

In accordance with another aspect of the invention, machines of the types described process such high volumes of flatware while meeting or exceeding recognized commercial sanitation standards. For example, in the apparatus shown in FIGS. 6–8, if the loading station is 20 inches long, when measured along the path of travel of the inner row of containers, the containers will be exposed for loading for 25 seconds. If the pre-wash station has a path of travel of the inner row of containers of 4 inches, the flatware will be pre-washed for five seconds. When the inner row containers are moved along a path of travel of 12 inches in the pressure wash station, the contained flatware will be exposed to washing action for 15 seconds. An eight inch path of travel in the rinse station provides 10 seconds of rinsing action. Twenty-four inches of travel in a drying station provides 30 seconds of drying action. When the containers are moved through a 4 inch discharge station, 5 seconds is alloted to flatware discharge. Such pre-washing, pressure washing and rinsing times meet or exceed time and distances set out in Standard No. 3, Paragraphs 6.07 and 6.08 as promulgated by the National Sanitation Foundation, as suitable washing and rinsing fluid pressures, volumes and spray patterns are applied.

Figure 11:
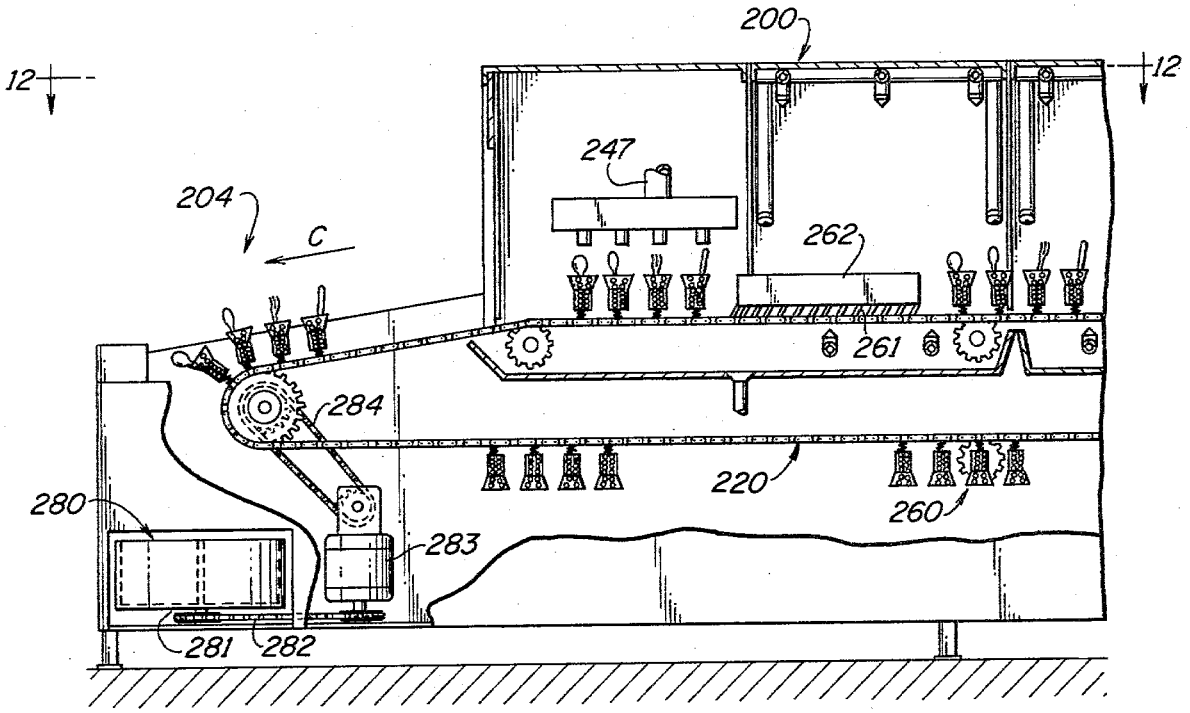
FIG. 11 is a fragmentary, elevational view, partly in section, of apparatus for washing flatware as well as other tableware and utensils.

Another embodiment of this invention is shown in part in FIG. 11. Here, apparatus and methods are provided for processing not only flatware, but other tableware within the same apparatus at the same time the flatware is being processed and discharged by category. In accordance with this aspect of the invention, cabinetry 200 incorporates a loading station (not shown) internal processing stations and a discharge station 204. In addition, the cabinetry 200 houses an endless conveyor 220, operating in the direction of arrow C, which carries a repetitive series of like container groups 260 and known dish holding fingers 261 throughout its entire length. In the manner commonly known, cups, glasses and other small items in standard dishwashing machine racks 262 may be placed upon fingers 261 or loose dishes may be placed directly between the fingers 261. As shown, a plurality of flatware receiving receptacles 280 are also housed in cabinet 200 at the discharge end thereof.

It will be understood that such combination apparatus may have container groups 260 arrayed transversally upon the conveyor 220 or, as herein shown, arrayed longitudinally in alignment with the direction of conveyor motion. These longitudinal container groups 260 may be immediately successive of one another with the distance between groups being equal to the distance between containers within the groups, thereby providing that all containers are equally spaced apart on the conveyors. Alternatively, as illustrated, the container groups may be spaced apart from one another. In the arrangement of intermittent container groups 260 shown, dishwashing machine racks 262 may be placed upon the conveyor 220 between container groups 260, thus permitting the use of standard size racks 262 and a standard width conveyor 220 to reduce manufacturing costs. In this novel apparatus such loose items are preferably placed, as shown, adjacent to container groups 260, thereby alloting the full width conveyor space between container groups 260 for standard size racks 262.

In operation, flatware is placed in the appropriate containers by category as previously described. The machine operator, or additional machine operators, simultaneously load other soiled tableware on the conveyor as the conveyor passes through the loading station. At the discharge station 204 another machine operator manually removes the other tableware while the flatware is automatically discharged by container inversion in the manner previously described.

Figure 12:
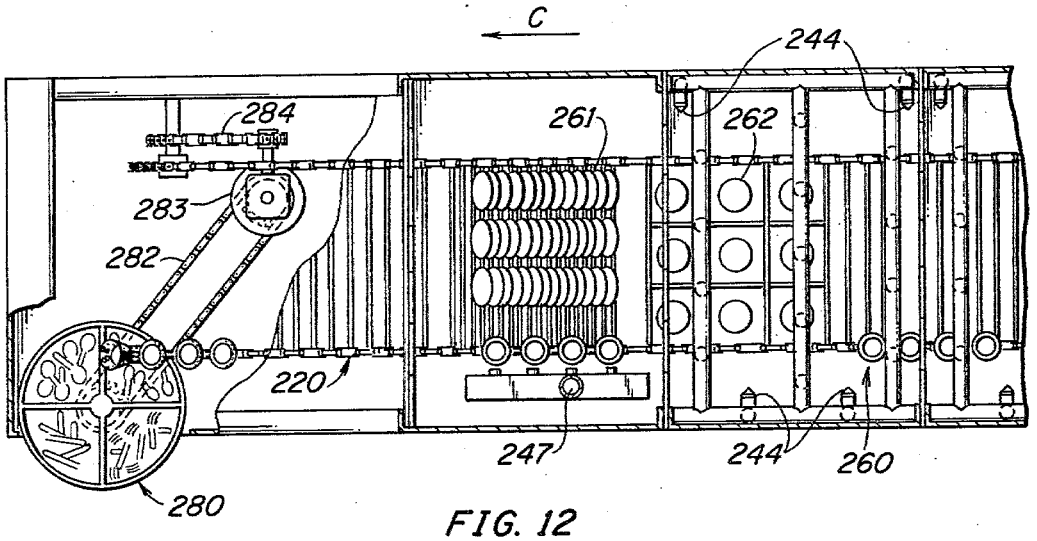
FIG. 12 is a sectional view taken along the line 12—12 of FIG. 11.

Here, however, the discharge station 204 affords but a single point of container inversion and flatware discharge. Therefore, as shown in FIGS. 11 and 12, the novel apparatus and methods of the invention provides that flatware segregation by category shall be maintained by implementation of a series of movable flatware receiving receptacles 280 as carried, or resting upon, for example, a rotating turntable 281 conveniently disposed below said single point of container inversion. The number of such movable receptacles 280 is equal to the number of categories of flatware containers per container group 260. The embodiment of the invention shown in FIGS. 11 and 12 includes a turntable 281, the rotation of which is synchronized with the conveyor movement as by means of chains 282 and 284 and a conveyor and turntable drive motor 283, or like known power transmission devices. Such synchronized drive means provides that a specific receiving receptacle 280 passes directly below the single point of container inversion and flatware discharge as the containers of like specific category discharge flatware. Automatic flatware segregation by category is thereby indefinitely maintained. The synchronization described above therefore provides that any subsequent container group 260, spaced upon the conveyor as described, reaches the point of discharge as the receiving receptacles rotate in continued correlation with the specific flatware categories of containers in such successive container group 260. As a result, all flatware of given category is discharged into but one specific receptacle 280. Alternate means to maintain synchronization between movable receiving receptacles and corresponding containers may be used in carrying out the present invention and may, for example, include other known intermittent drive means, not shown, such as a Geneva drive or an interrupter clutch influencing receiving receptacle motion. In addition, it will be understood that stationary receiving receptacles can be provided and a rotatable or otherwise movable ducting, not shown, can be mounted between the discharge station and the receptacles so as to direct the discharge flatware to the appropriate receiving receptacle.

As an example of one system of synchronization, when the first container of each such container group is designated to contain boullion spoons, and the center-to-center distance from a given boullion spoon container to the next boullion spoon container is tweleve inches, the synchronized drive means provides that a receiving receptacle for boullion spoons shall be moved into position directly below the point of container inversion for each tweleve inches of conveyor travel. Accordingly, in accordance with a further feature of this invention the overall length of a flight-type conveyor employed to convey longitudinally arrayed flatware container groups is a multiple of the distance, as cited above, from the center of a given container in one group to the center of the corresponding container in the subsequent group.

When container groups 260 are intermittently arranged on the conveyor, as shown, the conveyor length that is devoid of containers is of such length that synchronization between flatware discharge from containers of a given category and positioning of a specific receiving receptacle is maintained. Accordingly, the space between groups shall be such that the distance from the center of a given container to the center of the corresponding container in the subsequent intermittent group shall be a multiple of the comparable distance when such groups are immediately successive to one another. For example, if the center of the first container in one group is twelve inches from the center of the first container in an immediately successive group, the centers of the first containers in intermittently spaced groups shall be twenty-four inches or a further multiple of twelve inches. Thusly, as the lengths of conveyor devoid of containers pass the point of container inversion, the turntable and receiving receptacles simply complete one or more revolutions without receiving flatware.

In combination machines as shown, spray nozzles 244 and air orifices 247 such as those previously described, are off-set as shown in FIG. 12 to be located adjacent the flatware containers without interfering with the passage of other tableware items carried by conveyor 220. As shown, conventional spray nozzles, not a part of the invention, are located directly above and below the conveyor for spraying of dishes, glasses and the like.

Combination machines, like the essential embodiments of the invention, are not limited to a given form. For example, there may be provided a combination apparatus wherein all functions are like those of the foregoing machine except that a carousel conveyor is utilized. Here again, container groups may be aligned longitudinally upon the conveyor as shown in FIGS. 11 and 12, or may be disposed transversally as shown in FIGS. 5, 6 and 7 with other dishware disposed between said transversal container groups.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. Flatware washing apparatus comprising in combination, a loading station, a processing station for washing articles passed therethrough, a discharge station, a plurality of perforated washing containers for holding pieces of flatware in a substantially upright position, driven endless conveyor means attached to said containers for moving said containers through a closed circuit from station to station so as to cause flatware placed in said containers at said loading station to be moved through said washing station to said discharge station in a substantially upright condition, a plurality of flatware receiving receptacles for receiving said pieces of flatware, discharge means located at said discharge station for automatically discharging said flatware from each of said containers into respective ones of said receptacles, each of said containers comprising a generally cylindrical body portion having an outwardly flared top portion and a bottom having a generally convex upper surface spaced from the lower edge of said cylindrical body portion, means hingedly connecting said bottom to said cylindrical body portion, a cam follower carried by said bottom, and cam track means located at said loading and washing stations for cooperating with said cam follower to hold said bottom in a flatware holding position beneath said cylindrical body portion as said containers move through said loading and washing stations, whereby soiled flatware may be sorted as it is loaded into said containers at said loading station and is thereafter automatically washed and discharged through the bottoms of said containers in the sorted condition into said receptacles.

2. Flatware washing apparatus comprising in combination, a loading station, a processing station for washing articles passed therethrough said processing station including a plurality of high pressure liquid spray means laterally positioned along the path of container travel for imposing intermittent movement of flatware within said containers to facilitate exposure of all surfaces of each item of flatware to the sprays, a discharge station, a plurality of washing containers for holding pieces of flatware in a substantially upright position and each washing container including internal projection means causing said flatware to twist as it is carried past said spray means, driven endless conveyor means attached to said containers for moving said containers through a closed circuit from station to station so as to cause flatware placed in said containers at said loading station to be moved through said washing station to said discharge station in a substantially upright condition, a plurality of flatware receiving receptacles for receiving said pieces of flatware, and discharge means located at said discharge station for automatically discharging said flatware from each of said containers into respective ones of said receptacles, whereby soiled flatware may be sorted as it is loaded into said containers at said loading station and is thereafter automatically washed and deposited in the sorted condition into said receptacles.

3. Flatware washing apparatus comprising in combination, a loading station, a processing station for washing articles passed therethrough including a plurality of high pressure liquid spray means laterally positioned along the path of container travel, a discharge station, a plurality of perforated washing containers for holding pieces of flatware in a substantially upright position, driven endless conveyor means, spring means attaching said containers to said conveyor means, said conveyor means moving said containers through a closed circuit from station to station so as to cause flatware placed in said containers at said loading station to be moved through said washing station to said discharge station in a substantially upright condition and to be jostled by the sprays from said spray means, a plurality of flatware receiving receptacles for receiving said pieces of flatware, and discharge means located at said discharge station for automatically discharging said flatware from each of said containers into respective ones of said receptacles, whereby soiled flatware may be sorted as it is loaded into said containers at said loading station and is thereafter automatically washed and deposited in the sorted condition into said receptacles.

4. Flatware washing apparatus comprising in combination, a loading station, a processing station including liquid spray means for washing articles passed therethrough, a discharge station, a plurality of perforated washing containers for holding pieces of flatware in a substantially upright position, driven endless conveyor means conveyor-container attachment means attaching said conveyor to said containers, said conveyor means moving said containers through a closed circuit from station to station so as to cause flatware placed in said containers at said loading station to be moved through said washing station to said discharge station in a substantially upright condition, said conveyor-container attachment means includes flexible attachment means of such rigidity that spray pressure upon the upper regions of the container and its contents cause the container to temporarily tilt; thereby providing an intermittent tilting of the containers with resulting shifting and relative motion of flatware contents as the containers pass through the sprays, a plurality of flatware receiving receptacles for receiving said pieces of flatware, and discharge means located at said discharge station for automatically discharging said flatware from each of said containers into respective ones of said receptacles, whereby soiled flatware may be sorted as it is loaded into said containers at said loading station and is thereafter automatically washed and deposited in the sorted condition into said receptacles.

5. Flatware washing apparatus comprising in combination, a loading station, a processing station for washing articles passed therethrough, a discharge station, a plurality of perforated washing containers for holding pieces of flatware in a substantially upright position, driven endless conveyor means attached to said containers for moving said containers through a closed circuit from station to station so as to cause flatware placed in said containers at said loading station to be moved through said washing station to said discharge station in a substantially upright condition, a plurality of flatware receiving receptacles for receiving said pieces of flatware, and discharge means located at said discharge station for automatically discharging said flatware from each of said containers into respective ones of said receptacles, said conveyor being of the carousel type and comprising means for moving said containers in a continuous horizontal plane, and said discharge means comprising means for selectively opening the bottoms of said containers to discharge the flatware from the containers, whereby soiled flatware may be sorted as it is loaded into said containers at said loading station and is thereafter automatically washed and deposited in the sorted condition into said receptacles.

6. A method of sorting and washing flatware, comprising the steps of providing a plurality of washing containers respectively attached to a driven conveyor which moves the containers through a loading station, then through a washing station including fluid sprays and then through a discharge station, placing flatware items of like category in respective ones of said containers as said containers move through said loading station, moving said flatware items against internal container projections by said fluid sprays, so as to facilitate relative movement of the items in the containers, providing a plurality of receiving receptacles for respectively receiving flatware items of said like categories, and automatically discharging said items of flatware into the corresponding receptacles as said containers move through said discharge station.

7. A method of sorting and washing flatware, comprising the steps of providing a plurality of washing containers respectively attached to a driven conveyor which moves the containers through a loading station, then through a washing station and then through a discharge station, placing flatware items of like category in respective ones of said containers as said containers move through said loading station, providing a plurality of receiving receptacles for respectively receiving flatware items of said like categories, and automatically discharging said items of flatware into the corresponding receptacles as said containers move through said discharge station by automatically opening hinged container bottoms at said discharge station.

8. A method of sorting and washing flatware, comprising the steps of providing a plurality of washing containers respectively attached to a driven conveyor which moves the containers along a common path through a loading station, then through a washing station and then through a discharge station, placing flatware items of like category in respective ones of said containers as said containers move through said loading station, providing a plurality of receiving receptacles for respectively receiving flatware items of said like categories, and automatically discharging said items of flatware into the corresponding receptacles as said containers move through said discharge station by moving separate ones of said receptacles below the discharge station in a synchronized sequence so that a specific receptacle is positioned to receive flatware as each container of a specific category reaches the discharge station.

9. A method of washing and automatically discharging flatware according to claim 7 wherein the step of automatically opening a container bottom at the discharge station comprises the steps of causing cam follower associated with the hinged container bottom to follow a cam track whenever the container is located at a position other than at the discharge station, and causing the cam follower to disassociate from the cam track when the container is at the discharge station, thereby causing the container bottom to open and flatware contents to egress from the container and be discharged from the container.

* * * * *